US009273403B2

(12) United States Patent
Bulan et al.

(10) Patent No.: US 9,273,403 B2
(45) Date of Patent: Mar. 1, 2016

(54) METHOD FOR IMPROVING THE PERFORMANCE OF NICKEL ELECTRODES

(75) Inventors: Andreas Bulan, Langenfeld (DE); Rainer Weber, Odenthal (DE); Richard Malchow, Cologne (DE); Rolf Spatz, Bergisch-Gladbach (DE); Hermann-Jens Womelsdorf, Neuss (DE)

(73) Assignee: Covestro Deutschland AG, Leverkusen (DE)

( * ) Notice: Subject to any disclaimer, the term of this patent is extended or adjusted under 35 U.S.C. 154(b) by 0 days.

(21) Appl. No.: 13/602,827

(22) Filed: Sep. 4, 2012

(65) Prior Publication Data

US 2012/0325674 A1 Dec. 27, 2012

Related U.S. Application Data

(63) Continuation of application No. 12/016,291, filed on Jan. 18, 2008, now abandoned.

(30) Foreign Application Priority Data

Jan. 24, 2007 (DE) ..... 10 2007 003 554

(51) Int. Cl.

| | |
|---|---|
| ***C25D 3/50*** | (2006.01) |
| ***C25D 3/56*** | (2006.01) |
| ***C25D 5/18*** | (2006.01) |
| ***C25D 21/18*** | (2006.01) |
| ***C25D 21/14*** | (2006.01) |
| ***C25B 1/46*** | (2006.01) |
| ***C25B 11/04*** | (2006.01) |
| ***C25B 15/08*** | (2006.01) |

(52) U.S. Cl.

CPC ..... *C25B 1/46* (2013.01); *C25B 11/0405* (2013.01); *C25B 11/0447* (2013.01); *C25B 15/08* (2013.01); *C25D 3/50* (2013.01); *C25D 3/567* (2013.01); *C25D 5/18* (2013.01); *C25D 21/14* (2013.01); *C25D 21/18* (2013.01)

(58) Field of Classification Search

CPC ..... C25D 21/12; C25D 3/50; C25D 3/52; C25D 5/18

USPC ..... 205/102, 103, 257, 264

See application file for complete search history.

(56) References Cited

U.S. PATENT DOCUMENTS

| | | | | | |
|---|---|---|---|---|---|
| 3,276,976 | A | * | 10/1966 | Juliard | 205/104 |
| 4,105,516 | A | | 8/1978 | Martinsons et al. | |
| 4,160,704 | A | | 7/1979 | Kuo et al. | |
| 4,292,159 | A | * | 9/1981 | Kuo et al. | 204/237 |
| 4,555,317 | A | | 11/1985 | Nicolas et al. | |
| 4,587,001 | A | | 5/1986 | Cairns et al. | |
| 5,035,789 | A | | 7/1991 | Beaver et al. | |
| 5,227,030 | A | | 7/1993 | Beaver et al. | |
| 5,421,991 | A | * | 6/1995 | Yarita | 205/257 |
| 5,855,751 | A | * | 1/1999 | Rangarajan et al. | 204/290.12 |
| 5,871,630 | A | * | 2/1999 | Bhattacharya | C23C 28/023 136/264 |
| 2004/0112754 | A1 | * | 6/2004 | Thate | C25D 7/00 205/102 |
| 2004/0238373 | A1 | | 12/2004 | Kim et al. | |
| 2006/0149091 | A1 | | 7/2006 | Gallenkamp et al. | |

FOREIGN PATENT DOCUMENTS

| | | | |
|---|---|---|---|
| CA | 2107442 | A1 | 4/1994 |
| DE | 4232958 | C1 | 9/1993 |
| EP | 129374 | | 12/1984 |
| EP | 0298055 | A1 | 1/1989 |
| JP | 1011988 | | 1/1989 |
| WO | WO-03/082749 | A1 | 10/2003 |

OTHER PUBLICATIONS

Translation of JP 01-011988, Jan. 17, 1989.*

International Search Report for PCT/EP2008/000438, mailing date Aug. 5, 2008.

European Search Report for PCT/EP2008/000438, dated May 19, 2008.

* cited by examiner

*Primary Examiner* — James Lin

*Assistant Examiner* — Brian W Cohen

(74) *Attorney, Agent, or Firm* — Drinker Biddle & Reath LLP

(57) ABSTRACT

The invention relates to a method for improving the performance of nickel electrodes in alkali chloride electrolysis by adding water-soluble platinum compounds to the catolyte.

8 Claims, No Drawings

METHOD FOR IMPROVING THE PERFORMANCE OF NICKEL ELECTRODES

RELATED APPLICATIONS

This application is a continuation application of U.S. patent application Ser. No. 12/016,291, filed Jan. 18, 2008, which claims benefit of German Application No. 102007003554.5, filed Jan. 24, 2007, which is incorporated by reference herein in its entirety for all useful purposes.

FIELD OF THE INVENTION

The invention relates to a method for improving the performance of nickel electrodes in alkali chloride electrolysis.

BACKGROUND OF THE INVENTION

In sodium chloride electrolysis, hydrogen is evolved from an alkaline solution. Conventionally, the cathodes in the process are made of iron, copper, steel, or nickel. Nickel electrodes can be either solid nickel or nickel plated.

As mentioned in Offenlegungsschrift EP 298 055 A1, nickel electrodes can be coated with a metal from sub-group VIII, especially the platinum metals (inter alia Pt, Ru, Rh, Os, Ir, or Pd), of the periodic system of the elements or with an oxide of such a metal or with mixtures thereof. After a calcination process, the corresponding noble metal oxides are then usually present on the surface.

The electrode so produced can be used, for example, in sodium chloride electrolysis as the cathode for hydrogen development. Many coating variants are known, because the coating of metal oxides can be modified in very different ways so that different compositions form on the surface of the nickel electrode. According to U.S. Pat. No. 5,035,789, the cathode used is, for example, a ruthenium-oxide-based coating on nickel substrates.

Once in operation, the plating on the nickel electrode degrades and causes the cell voltage to increase, making necessary to re-coat the electrode. This is technically complex, because the electrolysis must be stopped and the electrodes must be removed from the electrolytic cells. An object of the invention is, therefore, to find a simpler method for increasing or restoring performance.

ELTECH has published and offered a technique with which a voltage reduction of from 200 to 300 mV as compared with untreated nickel electrodes can be achieved. In this technique, a noble-metal-containing solution of unnamed composition and constituents is applied in situ, i.e. during operation of the electrolysis, to the cathode side of the sodium chloride electrolysis in membrane cells. The solution is to be added during operation of the cell and is to lower the cell voltage.

According to the teaching of patent specification U.S. Pat. No. 4,555,317, iron compounds or finely divided iron is added to the catolyte in order to lower the cell voltage during sodium chloride electrolysis. The ELTECH publication contradicts this teaching, however, because, according to the information from ELTECH, coating the cathodes with iron is said to interfere with the electrolysis and to increase the cell voltage.

According to the further known Offenlegungsschrift EP 1 487 747 A1, a 0.1 to 10 wt. % platinum-containing compound is added to sodium chloride electrolysis. The solution of the platinum-containing compound is added to the water that forms the catolyte, from 0.1 to 2 liters of the aqueous solution of the platinum-compound-containing solution being added per liter of water.

According to JP 1011988 A, the activity of a deactivated cathode based on a Raney nickel structure with low hydrogen overvoltage is restored by adding, into the catolyte, a soluble compound of a metal of the platinum group to the sodium hydroxide solution during operation of the sodium chloride electrolysis. For example, a sodium chloride electrolytic cell with 32 wt. % sodium hydroxide solution, a salt concentration of 200 g/l of sodium chloride is operated at 90° C. and with a current density of 2.35 kA/m$^2$. The cathode is subjected to currentless nickelling for pretreatment and then nickel-plated in a nickel bath. Platinum chlorate, for example, was metered into the catolyte as the active compound, which resulted in a reduction in the cell voltage by 100 mV.

According to U.S. Pat. No. 4,105,516, metal compounds which are to lower the hydrogen overvoltage and accordingly reduce the cell voltage are added to the catolyte during the electrolysis of alkali metal chlorides. The examples given in U.S. Pat. No. 4,105,516 in turn describe the metering and effects that arise by addition of an iron compound added to the catolyte of a sodium chloride diaphragm laboratory cell. The cell has an anode, consisting of expanded titanium metal, which is coated with ruthenium oxide and titanium oxide. The cathode consists of iron in the form of extended metal. The examples show the use of cobalt solution or iron solution at the iron cathode. Reference has already been made above to the disadvantages of iron compounds in the treatment of coated nickel electrodes.

According to the further known patent specification U.S. Pat. No. 4,555,317, it is known that sodium chloride electrolysis can be started with a nickel-coated copper cathode. An initial metering under electrolysis conditions of the cell was carried out with hexachloroplatinic acid in three steps. In the first step, 2 mg of platinum were metered in per 102 cm$^2$, i.e. 0.02 mg/cm$^2$, in the second step about 0.03 mg/cm$^2$ and in the third step about 0.2 mg/cm$^2$. The cell voltage was lowered by a total of about 157 mV.

According to U.S. Pat. No. 4,160,704, metal ions having a low hydrogen overvoltage can be added to catolytes of a membrane electrolytic cell for sodium chloride electrolysis in order to coat the cathode. The addition takes place during the electrolysis. However, the only example given is the addition of platinum oxide in order to improve an iron or copper cathode.

Sodium chloride electrolysis according to the membrane process is known in the prior art. The process is carried out as follows: a sodium-chloride-containing solution is fed to an anode chamber having an anode, and a sodium hydroxide solution is fed to a cathode chamber having a cathode. The two chambers are separated by an ion-exchange membrane. Joining multiple anode and cathode chambers forms an electrolyser. The product streams from the anode chamber include chlorine and a less concentrated sodium-chloride-containing solution. The product stream from the cathode chamber includes hydrogen, and a more highly concentrated sodium hydroxide solution than was fed thereto. The volume flow of sodium hydroxide solution fed to the cathode chamber is dependent on the current density and the cell design. At a current density of, for example, 4 kA/m$^2$ and with the cell design of UHDE, Version BM 3.0, the volume flow of lye to the cathode chamber is, for example, between from 100 to 3001 l/h, with a concentration of the sodium hydroxide solution that comes off of from 30 to 33 wt. %. The geometrically projected cathode area is 2.71 m$^2$, this corresponds to the membrane area. The cathode is made of specially coated extended nickel metal provided with a special coating (manufacturer e.g. DENORA) in order to lower the hydrogen overvoltage.

The cathode coatings in sodium chloride electrolysis conventionally consist of platinum metals, platinum metal oxides or mixtures thereof, such as, for example, a ruthenium/ruthenium oxide mixture. As is described in EP 129 374, the platinum metals that can be used include ruthenium, iridium, platinum, palladium and rhodium. The cathode coating does not have long-term stability, in particular not under conditions in which electrolysis does not occur or during interruptions in the electrolysis, during which pole reversal processes, for example, can occur. Accordingly, more or less pronounced damage occurs to the coating over the operating time of the electrolyser. Likewise, impurities which pass, for example, from the brine into the lye, such as, for example, iron ions, can become deposited on the cathode or especially on the active centres of the noble-metal-containing coating and as a result can deactivate the coating. The consequence is that the cell voltage rises, with the result that the energy consumption for the production of chlorine, hydrogen and sodium hydroxide solution increases and the economy of the process is markedly impaired.

It is likewise possible for only individual elements to exhibit damage to the cathode coating, and it is not always economical to stop the entire electrolyser therefor and remove the element with the damaged coating, because this is associated with considerable production losses and costs.

Methods for improving nickel electrodes for sodium chloride electrolysis which are coated with elements of the platinum metals (sub-group VIII of the periodic system), referred to hereinbelow as platinum metals, their oxides or mixtures thereof, have not hitherto been directly known from the prior art.

SUMMARY OF THE INVENTION

The object of the invention is, therefore, to develop a specific method for improving nickel electrodes coated with platinum metals, platinum metal oxides or mixtures thereof, for use as cathodes in the electrolysis of sodium chloride, which process can be used while electrolysis operation continues and avoids a prolonged interruption in electrode operation to restore cathode activity.

The invention relates to a method for improving the performance of nickel electrodes that are used in a membrane sodium chloride electrolytic process comprising:

(a) preparing a water-soluble or alkali-soluble platinum solution comprising:

(i) a solvent and (ii) a soluble platinum compound and (b) adding the solution to the catolyte.

The invention provides a method for improving the performance of nickel electrodes having a coating based on platinum metals, platinum metal oxides or mixtures of platinum metals and platinum metal oxides, for sodium chloride electrolysis according to the membrane process, characterised in that, in the electrolysis of sodium chloride, a water-soluble or alkali-soluble platinum compound, in particular hexachloroplatinic acid or especially preferably an alkali platinate, particularly preferably sodium hexachloroplatinate ($Na_2PtCl_6$) and/or sodium hexahydroxyplatinate ($Na_2Pt(OH)_6$), is added to the catolyte.

For purposes of the specification, the term "Group VIII metals" includes all metals listed in sub-Group VIII of the Periodic Table, their metal oxides, and any mixtures of the metals and metal oxides.

The term "nickel cathode" includes electrodes used as cathodes that are solid nickel or nickel plated, regardless of any additional metal coatings on the electrode.

The term "platinum solution" includes an alkali or water based solution containing at least platinum and the solvent.

DETAILED DESCRIPTION OF THE INVENTION

In this method it is possible in particular either to meter in the sodium hexachloroplatinate in the form of an aqueous solution or in alkaline solution, or the hexachloroplatinic acid is metered directly into the catolyte, in particular the sodium hydroxide solution, a reaction then taking place with the lye to form the chloroplatinate.

The addition of the platinum compound is effected in particular while the electrolysis is taking place, under normal electrolysis conditions, at a current density of from 0.1 to 10 $kA/m^2$, particularly preferably at a current density of from 0.5 to 8 $kA/m^2$.

In a further preferred form of the platinum addition, the electrolytic voltage is varied, after the addition of the platinum compound, in particular in a pulsed manner, in the range from 0 to 5 V in order to deposit platinum in a more finely divided form on the cathode. The voltage here describes the voltage between the anode and the cathode.

To that end it can be sufficient, depending on the rectifier used to produce the electrolytic direct voltage, to lower the cell voltage in order to use the residual ripple of the rectifier therefor. In an alternating voltage in the mentioned voltage range, the residual ripple of the rectifier can result with an amplitude of from 0.5 to 500 mV. Modern rectifiers scarcely possess any residual ripple, but it is possible to produce a residual ripple artificially. The residual ripple is between 20 and 100 Hz, for example.

If the amplitude is likewise regulated, it can be +100 or −100 mV around the resting potential for the time of the noble metal metering. The resting potential is the voltage at which no further current flows. That potential is normally about 2.1 to 2.3 V, depending on the cell technology and membrane used. However, it is also possible in particular to carry out the noble metal metering when the cell voltage is 0 V, in which case the amplitude must be chosen greater than the resting potential.

Higher modulated amplitudes are likewise conceivable.

Platinum metals that can be present in metal or metal oxide form as the electrode coating on the nickel within the scope of the invention are in particular ruthenium, iridium, palladium, platinum, rhodium and osmium.

In a further preferred form of the novel method, in addition to the platinum compound, at least one other further soluble compounds of sub-group 8 of the periodic system of the elements, in particular compounds of palladium, iridium, rhodium, osmium or ruthenium, can additionally be added. Such compounds are used in particular in the form of water-soluble salts or complex acids.

After deactivation has been detected, the addition in the case of first-time metering is preferably carried out as follows: a platinum compound is added to the catolyte, in the feed to the cathode chamber, at a cathode area of 2.71 $m^2$, from 0.02 to 11 g Pt per cathode element, corresponding to from 0.007 $g/m^2$ to 4 $g/m^2$, at a current density of from 1 to 8 $kA/m^2$. The area used as the basis is the geometrically projected cathode area, which also corresponds to the membrane area. The rate of metering can be such that the platinum-containing solution, based on the platinum content per $m^2$ of cathode area, is metered at a rate of from 0.001 g Pt/($hm^2$) to 1 g Pt/($hm^2$).

The addition can take place at a current density preferably under normal operating conditions, or alternatively at a higher or lower current density. For example, the addition can take place at a current density of in particular from 0.1 to 10 kA/$m^2$.

The temperature at which the metering of the platinum compound preferably takes place is from 70 to 90° C. The metering can also take place at a lower temperature, however.

If a further voltage increase is observed when metering is complete, this can immediately be offset by metering again. This metering requires a markedly smaller amount of noble metal in order to restore the original voltage. Depending on the quality of the brine, the lye or on stoppages, a further, but smaller addition of platinum may be necessary within a period of from 1 to 3 weeks. The addition of the platinum compound to the catolyte can likewise take place in the feed to the cathodes. The required amounts of platinum are to be calculated according to the scale of the damage. In the case of relatively considerable damage, corresponding to a high voltage increase, more platinum must be metered in, while correspondingly less platinum must be metered in the case of slight damage, corresponding to a slight voltage increase. Overdosing with platinum does not result in any further improvement or lowering of the cell voltage, however.

The amount, based on the platinum, of the further soluble compounds from sub-group 8 in the solution to be added is particularly preferably from 1 to 50 wt. %.

In a preferred embodiment, the variation in the electrolytic voltage can be effected by superimposing an alternating voltage on the electrolytic voltage. The frequency of the superimposed alternating voltage is in particular from 10 to 100 Hz. The amplitude can then be from 10 to 200 mV.

By means of the method according to the invention it is possible for the first time to effect a voltage reduction by up to 200 mV in the case of damaged nickel electrodes coated with ruthenium and/or ruthenium oxides or mixtures thereof.

The preparation of the alkali platinate can be carried out by reaction of hexachloroplatinic acid with lye. This can be carried out separately or directly in situ if, for example, hexachloroplatinic acid is metered directly into the sodium hydroxide supply to the elements or to the electrolyser. The hexachloroplatinic acid is particularly preferably metered directly into the feed to the elements.

EXAMPLES

Example 1

A commercial electrolyser having 144 elements whose nickel cathodes were provided with a coating based on ruthenium/ruthenium oxide from Denora was operated at a mean voltage of 3.12 V. Of these 144 elements, one exhibited a voltage increased by more than 100 mV as compared with the mean value. The following treatment cycle was begun: 65.88 liters of a hexachloroplatinate solution (1.19 g Pt/l) was metered at a rate of 10.98 l/h, during operation, into the sodium hydroxide solution (conc. 31.5%) of a membrane electrolyser at a current density of 4.18 kA/$m^2$ over a period of 6 hours. 78.25 g of platinum thus reached the surface of 144 cathodes (surface area of a cathode: 2.71 $m^2$). This corresponds to an amount of platinum of 0.21 g Pt/$m^2$. The cell voltage fell on average to 3.08 V, the current consumption rose to 4.57 kA/$m^2$. Converted to 4 kA/$m^2$, this corresponds to a reduction in the voltage by 80 mV, accordingly from 3.09 to 3.01. Elements having a markedly higher voltage were no longer present. On the following day, a further 16.44 liters of the same solution, corresponding to 0.05 g Pt/$m^2$, were metered in. The cell voltage did not improve further as a result.

After 9 days, the mean voltage rose to 3.02 V (based on 4 kA/$m^2$), so that further metering of platinum in the form of hexachloroplatinic acid was carried out. 4.12 liters of the hexachloroplatinate solution (1.19 g Pt/l) were thereby metered in uniformly in the course of 2 hours, so that 4.9 g of platinum reached the surface of 144 cathodes (0.012 g Pt/$m^2$). The electrolysis was continued during the metering, the mean voltage thereafter was 3.01 V.

The cell voltage at a current density of 4 kA/$m^2$ was on average 3.09 V before the metering and 3.01 V after the metering, which corresponds to a voltage reduction of 80 mV.

Example 2

A laboratory electrolytic cell was operated as described in Example 1 at a current density of 4 kA/$m^2$ at a cell voltage of 3.05 V with a standard cathode coating from Denora on the nickel cathode. After shutting down the cell without applying a protective potential, damage to the cathode coating occurred. A protective potential is conventionally applied during a shut-down in order to protect the coating of the cathode from damage. After re-starting, the cell voltage was 3.17 V.

A solution of hexachloroplatinate having a platinum content of 1250 mg/1 Pt was metered into the catolyte while the cell was operating. After metering the solution for 2 hours with a metered amount of 5 ml/h, the voltage fell to 3.04 V. A total of 12.5 mg of platinum (12.5 mg/100 $cm^2$) was added.

Example 3

The test of Example 2 was repeated, but a solution having a platinum concentration of 250 mg/l was metered in (same metering time and same feed capacity). Addition here 2.5 mg Pt/100 $cm^2$. The voltage fell from 3.16 V to 3.07 V, i.e. by 90 mV.

Further additional metering did not bring about any further voltage reduction.

Example 4 (Comparison)

A laboratory electrolytic cell was operated as described in Example 1 at a current density of 4 kA/$m^2$ at a cell voltage of 3.08 V with a standard cathode coating from Denora on nickel electrodes. After shutting down the cell without applying a protective potential, damage to the cathode coating occurred. A protective potential is conventionally applied during a shut-down in order to protect the coating of the cathode from damage. After re-starting, the cell voltage was 121 V.

A solution of rhodium(III) chloride having a rhodium content of 125 mg/l was metered in over a period of 4 hours at 5 ml/h. Metering was then continued for a further 2 hours with a solution having a concentration of 1250 mg/l and at 5 ml/h, as a result of which a further 50 mV voltage reduction was achieved. The voltage reduction was only 60 mV.

All the references described above are incorporated by reference in its entirety for all useful purposes.

While there is shown and described certain specific structures embodying the invention, it will be manifest to those skilled in the art that various modifications and rearrangements of the parts may be made without departing from the spirit and scope of the underlying inventive concept and that the same is not limited to the particular forms herein shown and described.

We claim:

1. A method for improving the performance of damaged nickel electrodes that are used in a membrane sodium chloride electrolytic process comprising:

(a) providing a nickel electrode coated with a platinum metal, a platinum metal oxide or mixtures thereof, (b) operating and damaging the nickel electrode in an electrolyzer at an electrolytic voltage, (c) preparing a water-soluble or alkali-soluble platinum solution comprising:

(i) a solvent and (ii) a soluble platinum compound, wherein the water soluble or alkali soluble platinum solution is metered at a rate of 0.001 g Pt/(hour*$m^2$) to 1 g Pt/(hour*$m^2$), and at a temperature from 70° C. to 90° C., (d) adding the platinum solution to a catolyte comprising sodium hydroxide, and (e) after the addition of the platinum solution, varying the electrolytic voltage, wherein the electrolytic voltage is in a range from 0V to 5V, and wherein the electrolytic voltage is varied by a difference of from 0.5 to 500 mV by superimposing an alternating voltage on the electrolytic voltage and wherein the frequency of the superimposed alternating voltage is from 10 to 100 Hz, thereby forming a coating on the nickel electrode, and (f) improving the performance of the nickel electrodes by a voltage reduction of up to 200 mV.

2. The method according to claim 1, wherein the platinum compound is a water-soluble salt or a complex acid.

3. The method according to claim 1, wherein the platinum solution is hexacholorplatinic acid, or an alkali platinate, or a mixture thereof.

4. The method according to claim 1, wherein the soluble platinum compound is $Na_2PtCl_6$, or $Na_2Pt(OH)_6$, or a mixture thereof.

5. The method according to claim 1, which further comprises at least one additional water-soluble compound from Group VIII of the Periodic Table are added to the platinum solution.

6. The method according to claim 5, wherein, the additional water-soluble compound, based on the amount of platinum in the platinum compound, are present in a concentration of 1 wt. % to 50 wt. %.

7. The method according to claim 1, wherein the metering of the platinum solution occurs during electrolysis and under a current density between 0.1 to 10 kA/$m^2$.

8. The method according to claim 1, wherein the nickel electrode is pre-coated with ruthenium, iridium, palladium, platinum, rhodium or osmium.

* * * * *